United States Patent [19]

Hirsch

[11] Patent Number: 4,793,030

[45] Date of Patent: Dec. 27, 1988

[54] SINGLE-OR MULTILAYER STRAP OF FLEXIBLE MATERIAL

[75] Inventor: Hermann Hirsch, Klagenfurt, Austria

[73] Assignee: Hermann Hirsch Leder- und Kunststoffwarenfabrik, Klagenfurt, Austria

[21] Appl. No.: 499,512

[22] Filed: May 31, 1983

[30] Foreign Application Priority Data

Jun. 9, 1982 [AT] Austria ..... 2252/82

[51] Int. Cl.[4] ..... A44C 5/18

[52] U.S. Cl. ..... 24/265 WS; 24/530; 24/543; 24/563

[58] Field of Search ..... 24/67.9, 265 EC, 265 WS, 24/561, 563, DIG. 9, DIG. 16, 530, 542, 543, 545, 546; 40/23 A; 132/46 R

[56] References Cited

U.S. PATENT DOCUMENTS

| | | | |
|---|---|---|---|
| 1,986,071 | 1/1935 | Ruske | 24/561 X |
| 2,129,494 | 9/1938 | Dinhofer | 24/265 WS |
| 3,082,773 | 3/1963 | Renstrom et al. | 24/561 X |
| 3,389,709 | 6/1968 | Sidelman | 132/46 R |
| 3,416,202 | 12/1968 | Sasaoka | 24/563 |
| 3,898,717 | 8/1975 | Schwartz | 24/561 |
| 4,397,577 | 8/1983 | Bauer | 24/545 X |

FOREIGN PATENT DOCUMENTS

| | | | |
|---|---|---|---|
| 80280 | 9/1894 | Fed. Rep. of Germany | 24/543 |
| 583229 | 1/1925 | France | 24/265 WS |
| 2166463 | 8/1973 | France . | |
| 333030 | 12/1935 | Italy | 24/265 WS |
| 428007 | 12/1947 | Italy | 24/265 WS |
| 131643 | 5/1929 | Switzerland | 24/265 WS |
| 11492 | 5/1911 | United Kingdom | 40/23 A |
| 417987 | 10/1934 | United Kingdom | 24/265 WS |

*Primary Examiner*—Kenneth J. Dorner
*Assistant Examiner*—James R. Brittain
*Attorney, Agent, or Firm*—Young & Thompson

[57] ABSTRACT

A watch strap comprising at least one layer of flexible material in the form of an elongated strip having an end portion adapted to be secured about a bar of a wristwatch, and a reversely bent member of spring metal secured to the inner side of said flexible material. The spring metal member has a bend adapted to encircle a watch bar and two legs which outwardly convex when the strap is in a position secured to a watch bar and is in use. At least one of the legs is convex in two orthogonal directions in that secured position and has a spring snap action, when the legs are pulled apart from each other, whereby the outwardly convex curvature in two orthogonal directions reverses to an outwardly concave curvature in two orthogonal directions to increase the distance between said legs to permit insertion or removal of a watch bar. A second strip of flexible material is secured to the underside of the first strip and to the underside of the outer of the two legs and terminates short of the bend.

3 Claims, 2 Drawing Sheets

SINGLE-OR MULTILAYER STRAP OF FLEXIBLE MATERIAL

Figure 1:
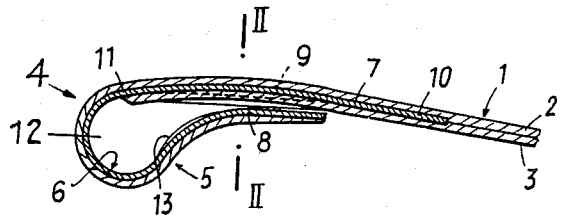

This invention relates to a single- or multilayer strap of flexible material, such as leather, plastic material or the like, comprising an end portion which has been reversely bent to form a loop and a substantially U-shaped, bent leaf spring which is connected to the strap adjacent to the loop.

It is known to fix the loop of a strap in that that end of the strap which has been reversely bent to form the loop is adhesively secured. It has also been proposed to provide the strap adjacent to its loop with metal strips, which when the end portion of the strap has been reversely bent to form the loop will take up part of the stress which has been set up in the strip material by the reverse bending. Finally, it is known to provide strap end portions with hook-like formations by which the strap can be hooked to webs, e.g., of watches. For instance, French Patent Specification No. 2,166,463 discloses a watch strap, which has a spring hook by which the strap can be secured to a watch. A leaf spring which has been bent substantially to a U-shape is provided in that portion that is to be secured to the watch.

A problem which arises in connection with the known loop designs resides in that the fixation and replacement of straps is difficult because the loops must be reliably closed for a safe fixation and should easily be opened for fixing and removing the strap.

It is an object of the invention so to improve a strap of the kind described first hereinbefore that the loop can easily be opened and closed.

This is accomplished according to the invention in that at least one of the legs of the leaf spring is curved, the concave side of the curve portion faces the other leg of the leaf spring and the distance between the strap and that end portion which has been reversely bent to form a loop can be increased in that the curved portion is forced through toward the other leg.

In the strap designed in accordance with the invention, the loop can be opened and closed simply in that the curved leg of the leaf spring is forced through in one direction and the other.

In a preferred embodiment that leg of the leaf spring which faces that end portion of the strap that has been reversely bent to form the loop is curved. In that embodiment, an additional result is produced in that the strap is also curved adjacent to the loop when the latter is closed, i.e., when the curved portion is outwardly convex, so that the strap has a particularly compact and attractive appearance.

Also within the scope of the invention, that leg of the leaf spring which is connected to the strap adjacent to that end portion of the strap which has been reversely bent to form the loop is bent to define an eyeletlike receiving space. That design provides an adequate space for receiving a spring bar, to which the strap is to be secured, e.g., a spring bar of a watch, whereas the closing of the loop is not adversely affected.

In an embodiment of the invention the free end portion of that leg of the leaf spring which is connected to the reversely bent end portion of the strap is angled toward the strap and to the other leg of the leaf spring. In that embodiment the free end of the strap portion that has been reversely bent to form the loop is also reliably in contact with the inside surface of the strap.

In single-layer straps, the leaf spring which is provided in accordance with the invention and bent in U-shape can be secured to the inside or outside surface of the strap, e.g., by adhesive. In multilayer straps according to the invention, such as watch straps, it is recommendable within the scope of the invention to provide the leaf spring at least in part between the face material and the lining. In that case the lining leather may extend over the entire inside surface of the strap, i.e., as far as to the free end of that strap portion which has been reversely bent to form the loop, or, for instance, only to the bent portion of the leaf spring or may terminate shortly before that bent portion.

It will be possible to open the loop to a particularly large extent if the curved leg of the leaf spring is longer than the other leg of the leaf spring and the curvature extends preferably only along part of the length of the leg.

Finally it is within the scope of the invention that leg of the leaf spring which is disposed adjacent to the reversely bent end portion is uncurved.

Figure 2:
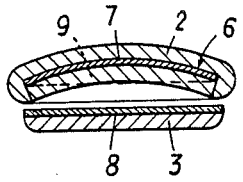
Figure 4:
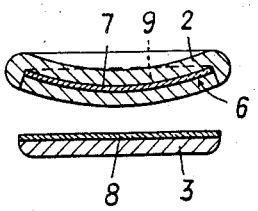
Figure 3:
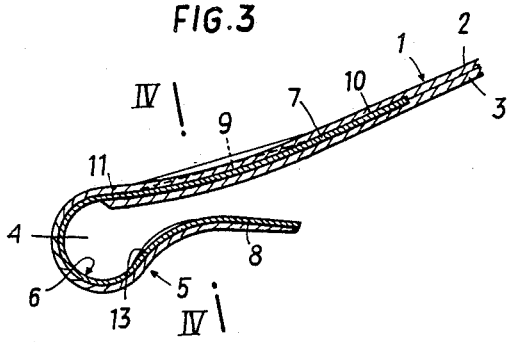

Further details and features of the invention will become apparent from the following description of illustrative embodiments shown on the drawings, in which:

FIG. 1 is a longitudinal sectional view showing the loop portion of a two-layer strap, FIG. 2 is a sectional view taken on line II—II in FIG. 1, FIG. 3 shows the strap of FIG. 1 with the loop opened, FIG. 4 is a sectional view taken on line IV—IV in FIGS. 3, and FIGS. 5 to 8 are perspective view showing U-shaped leaf springs which can be used within the scope of the invention.

The strap 1 shown in FIGS. 1 to 4 consists of the face material 2 and the lining 3, both of which may be leather. The end portion 5 of the strap 1 is reversely bent onto the strap 1 so as to form a loop 4. In the embodiment shown, the lining 3 extends as far as to the region of the loop 4 and is terminated there. In another conceivable embodiment the loop 3 extends as far as to the free end portion 5 of the strap 1. As is apparent from FIG. 2, the strap 1 may be bordered at its longitudinal side edges throughout its length or along part of its length in that the facing material 2 is folded around the two longitudinal side faces of the lining 3.

A leaf spring 6 which is bent substantially into U-shape is connected to the strap 1 adjacent to the loop 4. The leaf spring 6 has two legs 7 and 8. The leg 7 has a curved intermediate portion 9, which in accordance with FIGS. 5 and 6 extends along only part of the length of the leg 7. For this reason those portions 10 and 11 of the leg 7 of the leaf spring 6 which adjoin the curved portion 9 are flat. Similarly, the leg 8 of the leaf spring 6, i.e., that leg which is disposed adjacent to that end portion 5 of the strap 1 that has been reversely bent to form the loop, is flat except for a bent portion 13, which defines a space for receiving a web or the like.

Figure 5:
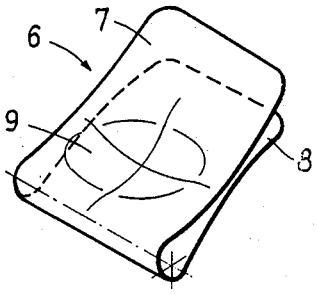

When the curved portion 9 of the leg 7 of the leaf spring 6 is forced through to the position shown in FIGS. 3 and 5, the loop 4 will be opened, as is shown in FIGS. 3 and 4 and the loop of the strap 1 can now be hung, e.g., over the spring rod of a watch. When the strap 1 has been hung, the curved portion 9 is forced back to the position shown in FIGS. 1 and 6 so that the loop is closed. The curved portion 9 can be forced back from the position shown in FIG. 3 to the position shown in FIG. 1 simply in that pressure is applied to the strap 1 from below approximately adjacent to that end portion 5 of the strap 1 which has been reversely bent to form the loop.

Figure 7:
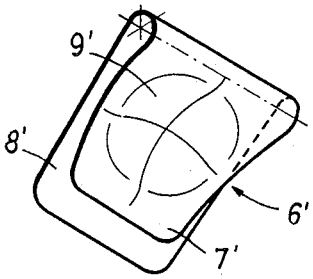
Figure 6:
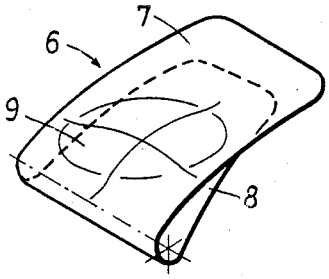
Figure 8:
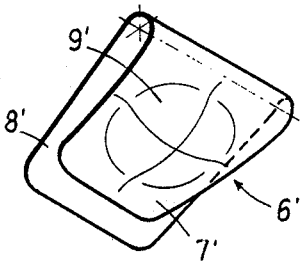

In the embodiment shown in FIGS. 7 and 8, the curved portion 9' is provided in that leg 8' of the leaf spring 6' which is disposed adjacent to that end portion 5 of the strap 1 which has been reversely bent to form the loop. The other leg 7' of the leaf spring 6' is substantially flat. In another embodiment (not shown) which can be conceived, both legs of the leaf spring are curved.

I claim:

1. A watch strap comprising at least one layer of flexible material in the form of an elongated strip having an end portion adapted to be secured about a bar of a wristwatch, and a reversely bent member of spring metal, said spring metal member having a bend adapted to encircle a said watch bar and two legs which are outwardly convex when the strap is in a position secured to a watch bar, that leg which is the outer of said legs when the watch strap is worn being secured to the inner side of said flexible material and being convex in two orthogonal directions in said secured position and having a spring snap action, when the legs are pulled apart from each other, whereby said outwardly convex curvature in two orthogonal directions reverses to an outwardly concave curvature in two orthogonal directions to increase the distance between said legs to permit insertion of removal of a said watch bar.

2. A strap according to claim 1, and a second strip of flexible material secured to the underside of said first strip and to the underside of the leg which is the outer of said two legs when the watch strap is worn.

3. A strap according to claim 2, in which said second strip terminates short of said bend.

* * * * *